US005647179A

United States Patent [19]

Hayashi et al.

[11] Patent Number: 5,647,179

[45] Date of Patent: Jul. 15, 1997

[54] ALUMINUM FRAME MEMBER

[75] Inventors: Shinji Hayashi; Hiroshi Omae, both of Toyama-ken, Japan

[73] Assignee: YKK Architectural Products Inc., Tokyo, Japan

[21] Appl. No.: 575,468

[22] Filed: Dec. 20, 1995

Related U.S. Application Data

[63] Continuation of Ser. No. 205,510, Mar. 4, 1994, abandoned.

[30] Foreign Application Priority Data

Mar. 12, 1993 [JP] Japan ..... 5-051869

[51] Int. Cl.[6] ..... E04B 2/96; E04F 19/06

[52] U.S. Cl. ..... 52/235; 52/515; 52/730.3; 52/734.2

[58] Field of Search ..... 52/235, 730.3, 52/730.4, 734.2, 515

[56] References Cited

U.S. PATENT DOCUMENTS

| | | | |
|---|---|---|---|
| 1,852,146 | 4/1932 | Carns et al. | 52/515 X |
| 3,081,849 | 3/1963 | Hubbard | 52/235 X |
| 3,208,795 | 9/1965 | Schultz | 52/515 X |
| 3,380,210 | 4/1968 | Neal et al. | 52/235 |
| 3,616,396 | 10/1971 | Swanson . | |
| 3,664,888 | 5/1972 | Oga et al. | 148/6.27 |
| 3,734,550 | 5/1973 | Vance | 52/235 X |
| 3,736,276 | 5/1973 | Crowne et al. . | |
| 3,858,375 | 1/1975 | Silvernail | 52/235 |
| 4,143,205 | 3/1979 | Jreta . | |
| 4,418,506 | 12/1983 | Weber et al. | 52/235 X |
| 4,564,397 | 1/1986 | Opsahl . | |
| 4,750,310 | 6/1988 | Holcombe | 52/235 X |
| 4,756,132 | 7/1988 | Newman et al. . | |
| 5,037,675 | 8/1991 | Kishi et al. | 427/258 |
| 5,040,347 | 8/1991 | Valvis | 52/235 |
| 5,235,790 | 8/1993 | Ishikawa | 52/235 |
| 5,481,839 | 1/1996 | Lobug et al. | 52/235 |

FOREIGN PATENT DOCUMENTS

| | | | |
|---|---|---|---|
| 3017200 | 11/1981 | Germany | 52/204.1 |
| 3-8219 | 1/1991 | Japan . | |
| 4-32405 | 8/1992 | Japan . | |
| 4-103910 | 9/1992 | Japan . | |
| 2220020 | 12/1989 | United Kingdom . | |
| WO93/18267 | 6/1993 | WIPO . | |

*Primary Examiner*—Robert Canfield

*Attorney, Agent, or Firm*—Finnegan, Henderson, Farabow, Garrett & Dunner, L.L.P.

[57] ABSTRACT

An aluminum frame member according to the present invention has an improved weather-proof characteristics and can be produced through a simplified and inexpensive fabrication process. The aluminum frame member comprises an interior side member and an exterior side member formed separately from each other. The interior side member has a panel support portion at the exterior side, and a surface of the interior side member is coated with a relatively inexpensive coating. The exterior side member has a panel support portion at the interior side, and a surface of the exterior side member is coated with a coating having weather-proof capacity which is higher than that of the coating of the interior side member. The exterior side member is fixed to the exterior side of the interior side member, thereby concealing from the exterior a portion of the interior side member which is otherwise exposed to the exterior.

10 Claims, 5 Drawing Sheets

ALUMINUM FRAME MEMBER

This application is a continuation of application Ser. No. 08/205,510, filed Mar. 4, 1994, now abandoned.

BACKGROUND OF THE INVENTION

1. Field of the Invention

The present invention relates generally to an aluminum frame member, such as a transverse frame member, vertical frame member or so forth, for forming a curtain wall, or sash.

2. Description of the Related Art

Typically, an aluminum frame member for a sash is colored into white, silver, black, gold or so forth by performing a surface treatment, such as anodic oxide film coating, on an extruded frame material.

In the area near the sea, corrosion of the aluminum frame member is accelerated due to salt damage. As a solution for this, Japanese Unexamined Utility Model Publication No. Hei 3-8219 discloses an aluminum frame member to which a fluorocarbon resin coating is applied on the exterior side surface to be exposed to the exterior after performing a surface treatment so as to improve weather-proof capacity.

In performing a surface treatment for coloring the extruded frame material, since the color on the overall surface becomes a uniform color so that the interior side surface and the exterior side surface of the aluminum frame member become the same color. Therefore, a sash formed by such aluminum frame member becomes the same color at the interior side and the exterior side. When different colors at the interior side and the exterior side are desired, it becomes necessary to perform the surface treatment with masking for one side which is not to be colored with one of the colors. Such surface treatment is cumbersome and labor-intensive.

In case of the aluminum frame member with the fluorocarbon resin coating on the exterior side surface exposed to the exterior for avoiding accelerated corrosion due to salt damage or so forth, the fluorocarbon resin coating operation has to be performed after performing a surface treatment on the overall surfaces. Such process is very cumbersome and labor-intensive.

This problem may be solved by performing the fluorocarbon resin coating on the overall surface of the aluminum frame member by way of surface treatment. However, since the fluorocarbon resin coating varnish is very expensive, the aluminum frame member with the fluorocarbon resin coating on the overall surface inherently becomes unacceptably expensive.

SUMMARY OF THE INVENTION

Therefore, it is an object of the present invention to provide an aluminum frame member which can solve the problems in the prior art set forth above.

In order to accomplish the above-mentioned and other objects, an aluminum frame member according to the present invention comprises:

an interior side member having a panel support portion at the exterior side, a surface of the interior side member being coated with a relatively inexpensive coating; and an exterior side member having a panel support portion at the interior side, a surface of the exterior side member being coated with a coating having weather-proof capacity which is higher than that of the coating of the interior side member, the exterior side member being formed separately from the interior side member and fixed to the exterior side of the interior side member, thereby concealing from the exterior a portion of the interior side member which is otherwise exposed to the exterior. Thus, a member coated with an expensive coating is used only for the exterior side portion of the building which requires corrosion-proof capacity and/or weather-proof capacity, while for the interior side portion which does not require corrosion-proof capacity and/or weather-proof capacity is used a member coated with an inexpensive coating, so that cost for the curtain wall portion of the building can be reduced without lowering its required capacity.

In a preferred embodiment as a vertical frame member, a panel is fixedly bonded to the panel support portion of the interior side member and to the panel support portion of the exterior side member respectively by means of a bonding seal material, the panel and the bonding seal material respectively serving as a part for concealing the interior side member from the exterior. In this embodiment, since the vertical frame member does not appear in the external view of the building, such design can be provided that panels are lined continuously in the transverse direction. Further, since the panel support portion of the interior side member is covered by the bonding seal material and the panel, it is free from fear of corrosion and discoloration though it is coated with a coating of low corrosion-proof and/or weather-proof capacity.

In a preferred embodiment as a transverse frame member, the panel support portion of the interior side member and the panel support portion of the exterior side member cooperatively define a recess for receiving a panel and support the panel through the intermediary of a seal material. In this embodiment of the transverse frame member, since the panel support portion of the interior side member is covered by the seal material, it is free from fear of corrosion and discoloration, similar to the case of the above mentioned vertical frame member.

Preferably, the interior side member has a hollow cross section. The hollow portion serves for enhancing the strength of the vertical frame member or the transverse frame member. Further, since a member in a hollow construction has a large outside surface, it is advantageous in respect of cost to provide the hollow portion in the interior side member to be coated with an inexpensive coating.

In one construction, the interior side member has a longitudinal engaging groove and the exterior side member has an engaging piece, the engaging piece being engaged with the engaging groove for fixing between the interior side member and the exteior side member.

In another construction, the interior side member has a pair of engagement receptacle pieces and the exterior side member has a pair of engaging pieces, the engaging pieces being engaged with the engagement receptacle pieces for fixing between the interior side member and the exterior side member.

Thus, the exterior side member and the interior side member are provided to be connected with each other by engagement of the engaging piece and the engagement receptacle portion and at the same time provided to mount a panel therebetween. For these provisions, construction of members as well as mounting of panels can be effected in a short time.

When a different design is desired between the internal view and the external view of the building, the interior side member and the exterior side member may be coated in different colors. The surface of the interior side member may be processed by electrocoating or by anodic oxide film coating, and the surface of the exterior side member may be processed by fluorocarbon resin coating.

BRIEF DESCRIPTION OF THE DRAWINGS

The present invention will be understood more fully from the detailed description given herebelow and from the accompanying drawings of the preferred embodiment of the invention, which, however, should not be taken to limit the scope of the present invention, but are for explanation and understanding only.

In the drawings.

DESCRIPTION OF THE PREFERRED EMBODIMENT

The preferred embodiment of an aluminum frame member according to the present invention will be discussed hereinafter with reference to the drawings. In the following description, numerous specific details are set forth in order to provide a thorough understanding of the present invention. It will be obvious, however, to those skilled in the art that the present invention may be practiced without these specific details. In other instances, well-known structures are not shown in detail in order not to unnecessarily obscure the present invention.

Figure 1:
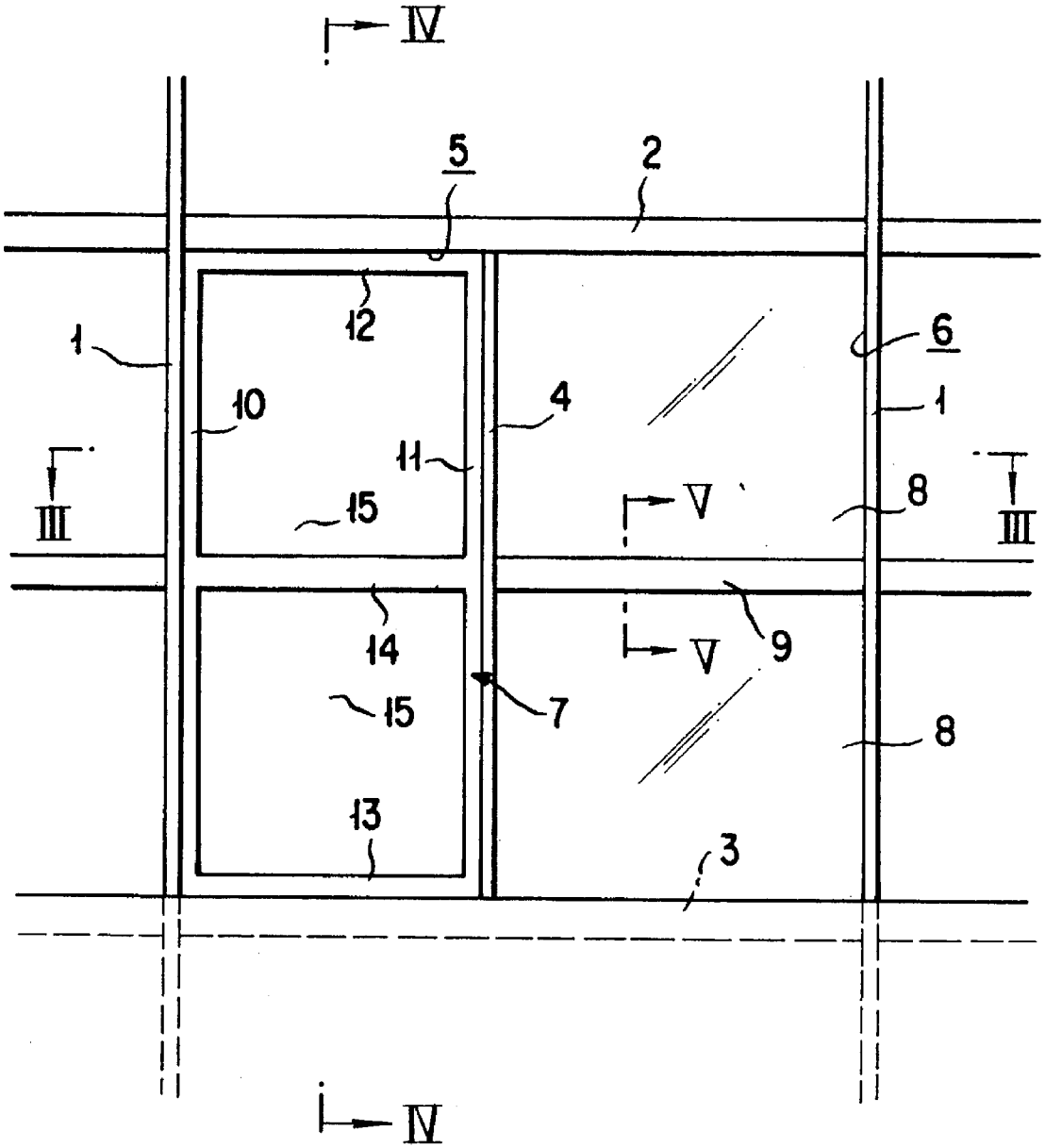
FIG. 1 is a general internal view of a sash formed of the preferred embodiment of an aluminum frame member according to the present invention.
Figure 2:
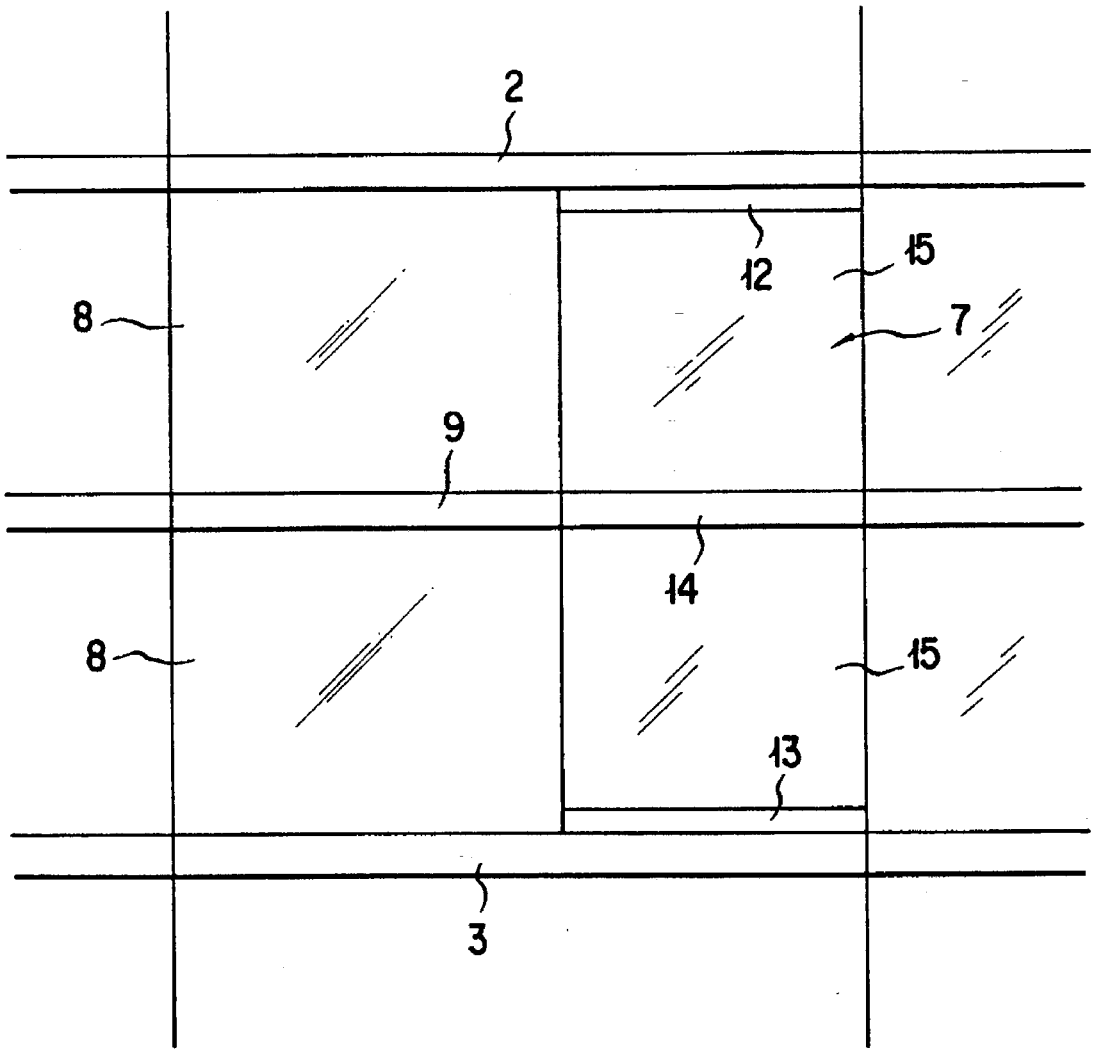
FIG. 2 is a general external view of the sash.

Referring now to FIGS. 1 and 2, between left and right mullions 1,1, an upper transom 2 and a lower transom 3 are extended transversely. Between the upper transom 2 and the lower transom 3, an intermediate vertical member 4 is vertically extended to form a first frame body 5 and a second frame body 6. In the first frame body 5 is pivotally mounted a panel unit 7, while in the second frame body 6 is mounted a panel 8. The reference numeral 9 denotes an intermediate horizontal member.

The panel unit 7 is formed by mounting a panel 15 in a framework assembly constituted of a left vertical framework 10, a right vertical framework 11, an upper framework 12, a lower framework 13 and a transom 14.

Figure 3:
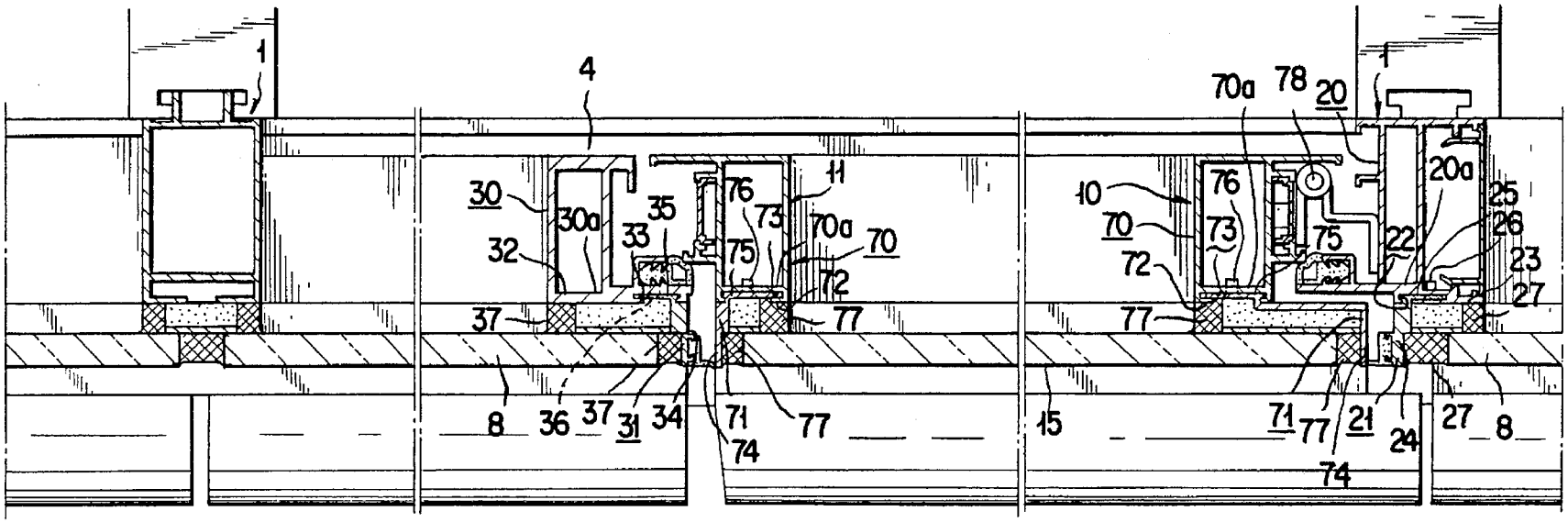
FIG. 3 is a section taken along line III—III of FIG. 1.

As shown in FIG. 3, the mullion 1 is constituted of a hollow interior side member 20 and an exterior side member 21. The interior side member 20 has an exterior side segment 20*a* which is formed with an engaging groove 22 continuously extending in the vertical direction and opening toward the exterior side. A panel support portion 23 in a plate form is provided integrally with the exterior side segment 20*a* of the interior side member 20. On the other hand, an engaging piece 25 which engages with the engaging groove 22 is provided integrally with a vertical plate form panel support portion 24 of the exterior side member 21. The engaging piece 25 is engaged with the engaging groove 22 and rigidly fixed to the exterior side segment 20*a* of the interior side member 20 by means of fastening screws 26.

A panel 8 is fixedly bonded to respective panel support portions 23 and 24 by means of a bonding seal material 27. Thus, the interior side member 20 is covered with the panel 8, the bonding seal material 27 and the exterior side member 21 so as not to be exposed to the exterior. Only the exterior side member 21 is exposed to the exterior.

In short, the exterior side member 21 performs both functions of supporting of the panel and of concealing of the interior side member 20 from the exterior.

As shown in FIG. 3, the intermediate vertical member 4 is constituted of a hollow interior side member 30 and an exterior side member 31. The interior side member 30 has an exterior side segment 30*a* which is formed with a panel support portion 32 and an engaging groove continuously extending in the vertical direction and opening toward the exterior side. On the other hand, an engaging piece 35 is provided integrally with a vertical plate form panel support portion 34 of the exterior side member 31. The engaging piece 35 is engaged with the engaging groove 33 and rigidly fixed to the exterior side segment 30*a* of the interior side member 30 by means of fastening screws 36.

A panel 8 is fixedly bonded to respective panel support portions 32 and 34 by means of a bonding seal material 37. Thus, the interior side member 30 is covered with the panel 8, the bonding seal material 37 and the exterior side member 31 so as not to be exposed to the exterior. Only the exterior side member 31 is exposed to the exterior.

In short, the exterior side member 31 performs both functions of supporting of the panel and of concealing of the interior side member 30 from the exterior.

Figure 4:
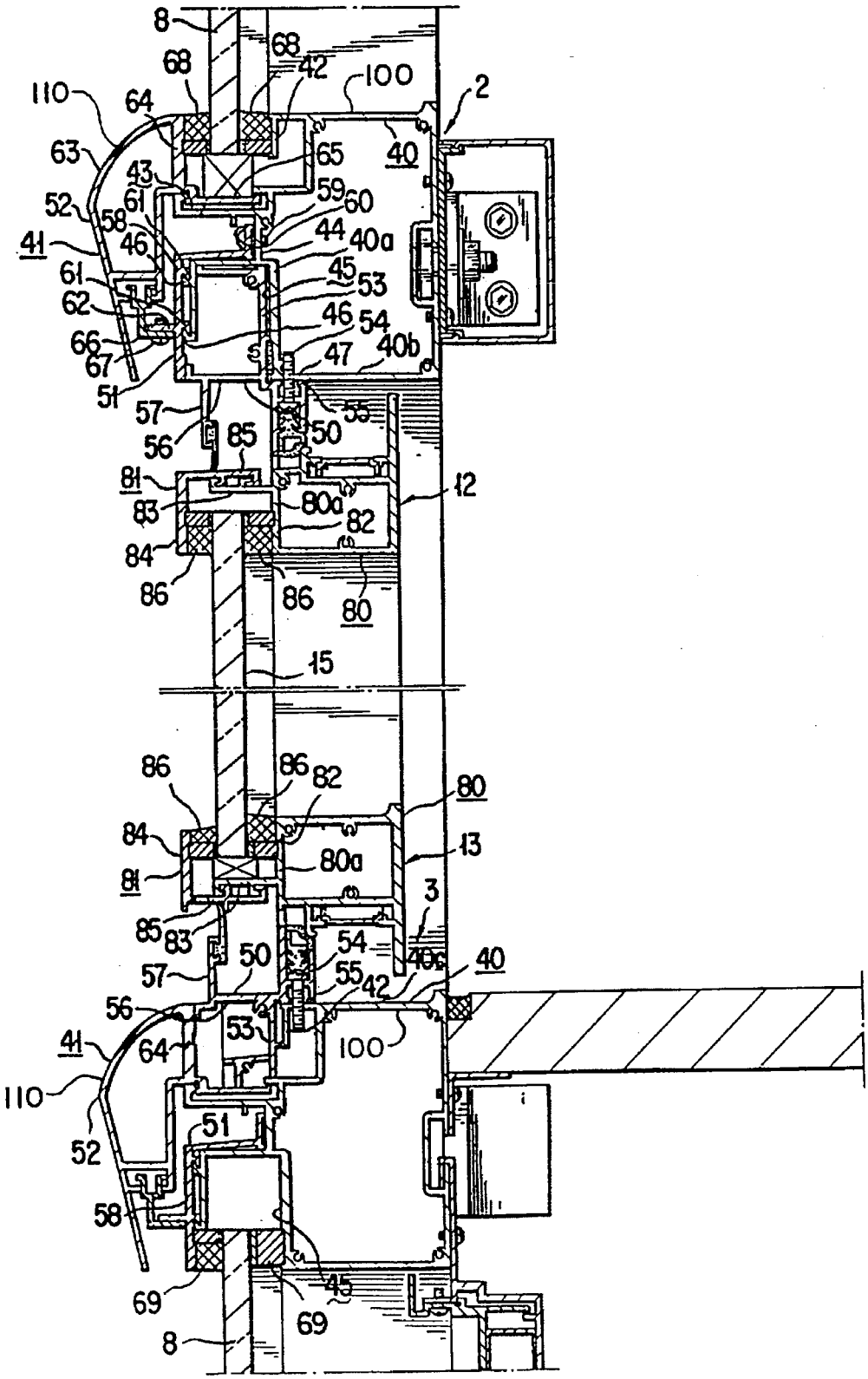
FIG. 4 is a section taken along line IV—IV of FIG. 1.

As shown in FIG. 4, the upper transom 2 is constituted of an interior side member 40 and an exterior side member 41. The interior side member 40 is in hollow construction and has an exterior side segment 40*a* which is integrally provided with a plate form panel support portion 42, a longitudinally extending continuous engaging groove 43 which opens upwardly, a first mount portion 44, a downwardly opened mounting recess portion 45. These portions are arranged in order with mutually offsetting in vertical direction. At the exterior side of the mounting recess portion 45, vertically arranged pair of engagement receptacle pieces 46, 46 are provided integrally therewith. Also, a second mount portion 47 is provided at the lower side portion 40*b* of the interior side member 40.

The exterior side member 41 comprises a first member 50, a second member 51 and a third member 52. The first member 50 has an L-shaped portion 53 which is bent in L-shaped configuration for engaging with the mounting recess portion 45, a mounting portion 55 provided integrally at the lower side of the L-shaped portion 53 for projecting toward the interior side and being rigidly fixed to the second mount portion 47 of the interior side member 40 by means of fastening screws 54, a plate form projecting portion 56 provided integrally at the lower side of the L-shaped portion 53 and directed toward the exterior side, and a plate form cover portion 57 provided on the projecting portion 56 integrally therewith and directed downwardly therefrom.

The second member 51 has an L-shaped portion 58 which is bent in L-shaped fashion, a mounting portion 60 integrally provided above the L-shaped portion 58 and rigidly fixed to the first mount portion 44 of the interior side member 40 by means of fastening screws 59, a pair of vertically arranged engaging pieces 61, 61 which are provided at the vertical portion of the L-shaped portion 58 and adapted to engage with the engagement receptacle pieces 46, 46 of the interior side member 40, and a projecting portion 62 provided at the lower portion of the L-shaped portion 58 integrally therewith and oriented toward the exterior side.

The third member 52 has a cover portion 63, a panel support portion 64, an engaging piece 65 and a projecting portion 66. The engaging piece 65 is engaged with the engaging groove 43 of the interior side member 40. The projecting portion 66 is rigidly fixed to the projecting portion 62 of the second member 51 by means of fastening screws 67. The panel 8 is supported between the panel support portion 42 of the interior side member 40 and the panel support portion 64 of the third member 52 through the intermediary of a seal material 68. Therefore, the interior side member 40 is covered with the exterior side member 41 so as not to be exposed to the exterior. Thus, the external side member 41 performs both functions of supporting the panel and covering the interior side member 40.

The lower transom 3 is of substantially the same configuration as that of the upper transom 2, and differentiated only in the configuration and the mounting position of the first member 50 and manner of supporting of the panel 8. In order to avoid redundant description for simplification of disclosure and for facilitating understanding of the invention, the following discussion will be concentrated to the portions different from those of the upper transom 2. It should be noted that the portions the same or similar to those of the upper transom 2 will be represented by the same reference numerals.

A mounting portion 55 of the first member 50 is rigidly fixed to an upper portion 40*c* of the interior side member 40 by means of fastening screws 54. A projecting portion 56 of the first member 50 is in contact with a panel support portion 64 of the third member 52.

The panel 8 is supported between the mounting recess portion 45 of the interior side member 40 and the lower portion of the L-shaped portion 58 of the second member 51 through the intermediary of a seal material 69.

Figure 5:
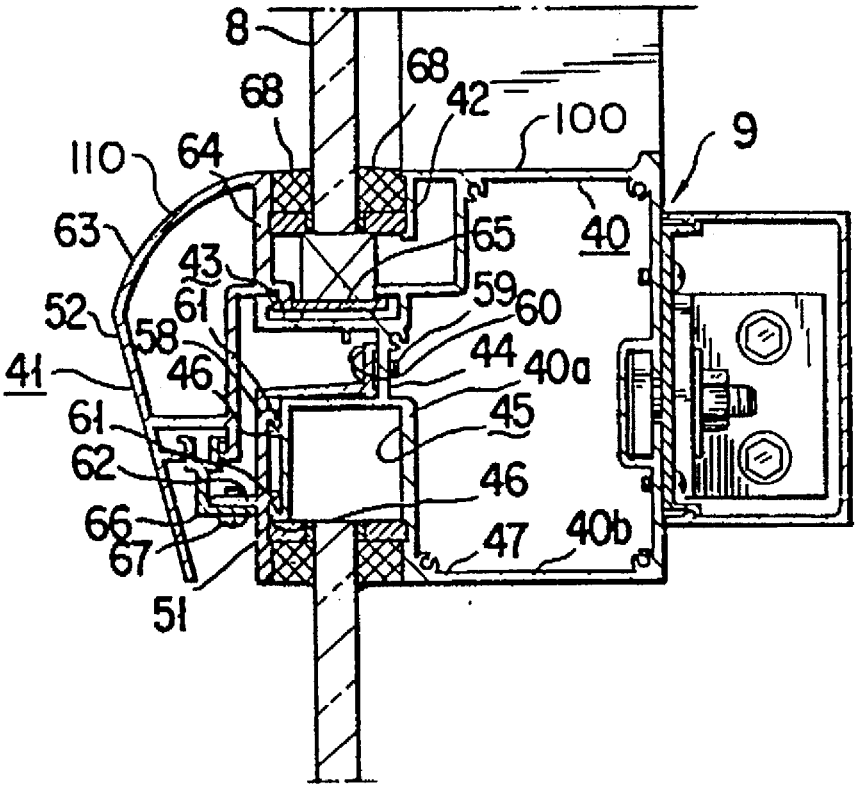
FIG. 5 is a section taken along line V—V of FIG. 1.

The intermediate transom 9 is in the configuration similar to the upper transom 2 but the first member 50 is omitted, as shown in FIG. 5. The upper side panel 8 is supported in the manner similar to the upper transom 2, and the lower side panel 8 is supported in the manner similar to the lower transom 3.

As shown in FIG. 3, each of the left and right vertical frameworks 10, 11 comprises a hollow interior side member 70 and an exterior side member 71. The exterior side portion 70*a* of the interior side member 70 is formed with a panel support portion 72 and an engaging groove 73 which continuously extends in the vertical direction and opens toward the exterior side. The exterior side member 71 has a vertical plate form panel support portion 74 which is integrally formed with an engaging piece 75. The engaging piece 75 is engaged with the engaging groove 73 and fixed to the exterior side portion 70*a* of the interior side member 70 by means of fastening screws 76.

The panel 15 is fixedly bonded to respective panel support portions 72 and 74 by means of a bonding seal material 77. Thus, the interior side member 70 is concealed by the panel 15, the bonding seal material 77 and the exterior side member 71 so as not to be exposed to the exterior side. Only the exterior side member 71 is exposed to the exterior.

Namely, the exterior side member 71 serves both for supporting the panel and for concealing the interior side member.

It should be appreciated that the panel support portion 74 of the exterior side member 71 of the left vertical framework 10 is formed into L-shaped configuration to provide a space for mounting a hinge 78.

As shown in FIG. 4, each of the upper and lower frameworks 12 and 13 comprises an interior side member 80 and an exterior side member 81. The exterior side portion 80*a* of the interior side member 80 includes a panel support portion 82 and a mount portion 83. On the other hand, the exterior side member 81 has a panel support portion 84 and a mounting portion 85 cooperatively forming an L-shaped configuration for concealing the interior side member 80. The mounting portion 85 is engaged with and rigidly fixed to the mount portion 83 for fixing between the interior side member 80 and the exterior side member 81. The panel 15 is supported between the panel support portions 82 and 84 through the intermediary of a seal material 86.

In the constructions of respective components set forth above, each of the interior side members is fabricated by performing a relatively inexpensive surface treatment, such as electrocoating, anodic oxide film coating or so forth, on the aluminum extruded material. On the other hand, each of the exterior side members are fabricated by performing a surface treatment giving an excellent weather-proof capacity, which is higher than the weather-proof capacity of the surface treatment of the inner side members, such as fluorocarbon resin coating or so forth on the aluminum extruded material. The interior side member and the exterior side member may be coated in different colors. As broadly embodied in FIGS. 4, and 5, a coating on the respective interior side member is depicted as coating 100, and a coating on the respective exterior side member is depicted as coating 110.

As set forth above, according to the present invention, since the interior side member is covered with the exterior side member having an excellent weather-proof capacity, weather proofing characteristics of the aluminum frame member as a whole can be enhanced. Also, since the exterior side member and the interior side member can be subject to respective surface treatment separately, the surface treatment operation can be significantly simplified. Further, since the interior side member may be coated with an inexpensive coating, cost of the aluminum frame member as a whole can be reduced. Furthermore, since the exterior side member and the interior side member can be processed separately, it becomes possible to easily change the color at the exterior side and interior side to increase variation of the internal and external designs.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above, but also includes all possible embodiments falling within the scope of the attached claims or their equivalents.

What is claimed is:

1. A curtain wall, comprising:

an interior member having a surface, an interior side, an exterior side, and a hollow portion of substantially rectangular cross section, the exterior side of said interior member having a vertically extending engaging groove and a first panel support portion integrally formed in the form of vertical plate, the surface of said interior member having a first coating with a first weather-proof capacity; and a separate exterior member having a surface, an interior side, an exterior side, a vertically extending engaging piece and a second panel support portion in the form of a vertical plate integrally formed with and perpendicularly extending from said engaging piece, the surface of said exterior member having a second coating with a second weather-proof capacity which is higher than the first weather-proof capacity of said first coating of said interior member;

said exterior member being fixed to the exterior side of said interior member with said engaging piece being engaged in said engaging groove, wherein a panel is bonded to said first panel support portion and said second panel support portion by means of a bonding seal material so that said interior member is sealed from exposure to an environment external to said panel by said exterior member, said panel, and said bonding seal material.

2. A curtain wall, comprising:

an interior member having a surface, an interior side, an exterior side, and a hollow portion of substantially rectangular cross section, the exterior side of said interior member having a first panel support portion integrally formed in the form of a transverse plate, a transversely extending engaging groove, and a mounting recess portion formed below said engaging groove so as to open in an opposite direction to said engaging groove, the surface of said interior member having a first coating with a first weather-proof capacity; and a separate exterior member comprising a first member, a second member and a third member, said first member having a first surface and a first L-shaped portion and being provided for receiving a panel unit which is installed for forming an openable window or door, said second member having a second surface and a second L-shaped portion, said third member having a third surface and a transversely extending engaging piece and a second panel support portion, the surfaces of said first, second and third members of the exterior member having a second coating with a second weather-proof capacity which is higher than the first weather-proof capacity of said first coating of said interior member;

said first member of said exterior member being fixed to said exterior side of said interior member with said first L-shaped portion being engaged in said mounting recess portion, said second member of said exterior member being fixed to said exterior side of said interior member with said second L-shaped portion being mounted on and overlapping the exterior side of said mounting recess portion, said third member being fixed to said exterior side of said interior member with said engaging piece being engaged in said engaging groove, wherein a panel is bonded to said first panel support portion and said second panel support portion by means of a bonding seal material so that said interior member is sealed from exposure to an environment external to said panel by said first, second and third members of said exterior member, said panel, and said bonding seal material.

3. A curtain wall, comprising:

an interior member having a surface, an interior side, an exterior side, and a hollow portion of substantially rectangular cross section, the exterior side of said interior member having a first panel support portion integrally formed in the form of a transverse plate, a transversely extending engaging groove, and a mounting recess portion formed below said engaging groove so as to open in an opposite direction to said engaging groove, the surface of said interior member having a first coating with a first weather-proof capacity; and a separate exterior member comprising a first member, a second member and a third member, said first member having a first surface and a first L-shaped portion and being provided for receiving a panel unit which is installed for forming an openable window or door, said second member having a second surface and a second L-shaped portion, said third member having a third surface and a transversely extending engaging piece and a second panel support portion, the surfaces of said first, second and third members of the exterior member having a second coating with a second weather-proof capacity which is higher than the first weather-proof capacity of said first coating of said interior member;

said second member of said exterior member being fixed to said exterior side of said interior member with said L-shaped portion being mounted on and overlapping the exterior side of said mounting recess portion, said third member being fixed to said exterior side of said interior member with said engaging piece being engaged in said engaging groove, said first member of said exterior member being fixed to said exterior side of said interior member with said first L-shaped portion being engaged between said first panel support portion and said second panel support portion, wherein a panel is bonded to said second L-shaped portion of said second member of said exterior member and said mounting recess portion of said interior member by means of a bonding seal material so that said interior member is sealed from exposure to an environment external to said panel by said first, second and third members of said exterior member, said panel, and said bonding seal material.

4. A curtain wall, comprising:

an interior member having a surface, an interior side, an exterior side, and a hollow portion of substantially rectangular cross section, the exterior side of said interior member having a first panel support portion integrally formed in the form of a transverse plate, a transversely extending engaging groove, and a mounting recess portion formed below said engaging groove so as to open in an opposite direction to said engaging groove, the surface of said interior member having a first coating with a first weather-proof capacity; and a separate exterior member comprising a second member and a third member, said second member having a L-shaped portion, said third member having a transversely extending engaging piece and a second panel support portion, the surfaces of said second and third members of the exterior member having a second coating with a second weather-proof capacity which is higher than the first weather-proof capacity of said first coating of said interior member;

said second member of said exterior member being fixed to said exterior side of said interior member with said L-shaped portion being mounted on and overlapping the exterior side of said mounting recess portion, said third member being fixed to said exterior side of said interior member with said engaging piece being engaged in said engaging groove, wherein a first panel is bonded to said first panel support portion and said second panel support portion by means of a bonding seal material, and a second panel is bonded to said L-shaped portion of said second member of said exterior member and said mounting recess portion of said interior member by means of a bonding seal material, so that said interior member is sealed from exposure to an environment external to said panel by said second and third members of said exterior member, said first and second panels, and said bonding seal material.

5. A curtain wall as set forth in claims 1, 2, 3 or 4, wherein said first coating has a first color and said second coating has a second color.

6. A curtain wall as set forth in claims 1, 2, 3 or 4, wherein said first coating includes a coating formed by a process of electrocoating.

7. A curtain wall as set forth in claims 1, 2, 3 or 4, wherein said second coating includes a coating formed by a process of fluorocarbon resin coating.

8. A curtain wall as set forth in claims 1, 2, 3 or 4, wherein said first coating includes a coating formed by a process of anodic oxide film coating.

9. A pivotable panel unit which is installed in a curtain wall comprising:

an interior member having a surface and a hollow portion of substantially rectangular cross section, an exterior side of said interior member having a vertically extending engaging groove and a first panel support portion integrally formed in the form of a vertical plate, the surface of said interior member having a first coating with a first weather-proof capacity; and a separate exterior member having a surface and a vertically extending engaging piece and a second panel support portion in the form of a vertical plate integrally formed with and perpendicularly extending from said engaging piece, the surface of said exterior member having a second coating with a second weather-proof capacity which is higher than the first weather-proof capacity of said first coating of said interior member;

said exterior member being fixed to the exterior side of said interior member with said engaging piece being engaged in said engaging groove, wherein a panel is bonded to said first panel support portion and said second panel support porion by means of a bonding seal material so that said interior member is sealed from exposure to an environment external to said panel by said exterior member, said panel, and said bonding seal material.

10. A panel unit which is installed in a curtain wall comprising:

an interior member having a surface, a first mounting portion and a first panel support portion in the form of a transverse plate, the surface of said interior member having a first coating with a first weather-proof capacity; and a separate exterior member having a surface, a second mounting portion and a second panel support portion in the form of a transverse plate, the surface of said exterior member having a second coating with a second weather-proof capacity which is higher than the first weather-proof capacity of said first coating of said interior member;

said exterior member being fixed to said interior member with said second mounting portion being engaged with said first mounting portion, wherein a panel is bonded to said first panel support portion and said second panel support portion by means of a bonding seal material so that said interior member is sealed from exposure to an environment external to said panel by said exterior member, said panel, and said bonding seal material.

* * * * *

UNITED STATES PATENT AND TRADEMARK OFFICE

CERTIFICATE OF CORRECTION

PATENT NO. : 5,647,179

DATED : July 15, 1997

INVENTOR(S) : Shinji HAYASHI et al.

It is certified that error appears in the above-indentified patent and that said Letters Patent is hereby corrected as shown below:

On the Title Page, Item [57], in the Abstract, line 2, before "improved", delete "an".

Claim 9, Col. 10, line 3, "porion" should read --portion--.

Signed and Sealed this

Thirtieth Day of December, 1997

*Attest:*

*Attesting Officer*

BRUCE LEHMAN

*Commissioner of Patents and Trademarks*